US011628104B1

(12) United States Patent
Hodges

(10) Patent No.: US 11,628,104 B1
(45) Date of Patent: Apr. 18, 2023

(54) ANTI-ROLLBACK MECHANISM FOR A WHEELCHAIR

(71) Applicant: Thomas E. Hodges, Farmington, AR (US)

(72) Inventor: Thomas E. Hodges, Farmington, AR (US)

( * ) Notice: Subject to any disclaimer, the term of this patent is extended or adjusted under 35 U.S.C. 154(b) by 547 days.

(21) Appl. No.: 16/793,232

(22) Filed: Feb. 18, 2020

(51) Int. Cl.
*A61G 5/00* (2006.01)
*A61G 5/10* (2006.01)

(52) U.S. Cl.
CPC ..... *A61G 5/1027* (2013.01); *A61G 5/1035* (2013.01); *A61G 5/1037* (2013.01)

(58) Field of Classification Search
CPC ... A61G 5/1027; A61G 5/1035; A61G 5/1037
USPC ..... 180/30
See application file for complete search history.

(56) References Cited

U.S. PATENT DOCUMENTS 4,045,047 A * 8/1977 Buckley ..... A61G 5/1027 188/82.2
4,320,818 A 3/1982 Knoche
4,560,033 A * 12/1985 DeWoody ..... A61G 5/1018 188/82.4
4,733,755 A 3/1988 Manning
4,762,332 A * 8/1988 Seol ..... A61G 5/025 280/258
5,197,750 A * 3/1993 DiGeorge ..... A61G 5/1086 D12/133
5,303,945 A * 4/1994 Oxford ..... A61G 5/027 280/244
5,746,437 A * 5/1998 Faber ..... A61G 5/02 280/250.1
6,371,503 B2 4/2002 Ritchie et al.
6,478,283 B1 * 11/2002 Figurel ..... A61G 5/1035 248/221.11
6,688,437 B2 2/2004 Usherovich
(Continued)

FOREIGN PATENT DOCUMENTS

FR 2928537 A1 * 9/2009 ..... A61G 5/02
GB 2490489 A 11/2012
JP 2004057401 A 2/2004

OTHER PUBLICATIONS

Wheelchair retreat prevention device. Patent Translation [online]. Google Patents [retrieved on Sep. 11, 2019]. Retrieved from the Internet: <URL:https://patents.google.com/patent/JP4216535B2/en?q=wheelchair&q=anti&q=roll&q=lever&oq=wheelchair+anti+roll+lever&page=1>.

*Primary Examiner* — James A Shriver, II
*Assistant Examiner* — Hilary L Johns
(74) *Attorney, Agent, or Firm* — Cramer Patent & Design, PLLC; Aaron R. Cramer

(57) ABSTRACT

An anti-pushback mechanism for a wheelchair provides for a side mounted lever to allow the wheelchair to move in a forward motion only, a rearward motion only, or a neutral position where it can be pushed in any direction. This lever is connected to a ratcheting style gear that stops rollback when engaged. A torsion spring moves the chair forward slightly as the user stands to keep the chair close to the user and prevent falling. The invention may be provided as an add-on kit for existing wheelchairs. The kit would consist of a center axle, the ratchet gear, the torsion spring, the crossbar frame, the actuating lever, a guard for the lever, and any associated clamps and fasteners.

20 Claims, 5 Drawing Sheets

(56) References Cited

U.S. PATENT DOCUMENTS

| | | | | |
|---|---|---|---|---|
| 6,755,430 | B1 * | 6/2004 | Watwood | A61G 5/1027 280/250.1 |
| 7,677,586 | B2 * | 3/2010 | Bloom | A61G 5/023 280/250.1 |
| 9,010,786 | B1 * | 4/2015 | Ekelem | A61G 5/1035 280/244 |
| 9,308,144 | B2 | 4/2016 | Derringer | |
| 10,124,666 | B2 * | 11/2018 | Cunningham | A61G 5/1008 |
| 10,245,193 | B2 * | 4/2019 | Gingras | A61G 5/1035 |
| 2008/0238023 | A1 * | 10/2008 | Bloom | A61G 5/023 280/250.1 |
| 2018/0042796 | A1 * | 2/2018 | Gingras | A61G 5/1035 |

* cited by examiner

ANTI-ROLLBACK MECHANISM FOR A WHEELCHAIR

FIELD OF THE INVENTION

The presently disclosed subject matter is directed to an anti-rollback mechanism and more specifically to an anti-rollback mechanism for a wheelchair.

BACKGROUND OF THE INVENTION

Handicapped people confined to wheelchairs are faced with obstacles on a daily basis that most of us take for granted. Simple travel from place to place becomes a major undertaking that requires considerable effort. While wheelchairs permit greater mobility and ease of movement, they are not without their own dangers. Perhaps the biggest of these is common occurrence of the wheelchair unintentionally rolling backwards. This occurs when the user or the care provider forgets to set the wheel brake (lock).

The rollback of the wheelchair causes the user to lose their balance resulting in rearward falls can cause head trauma, bone fractures, or worse. It is especially ironic when one considers that the wheelchair should be protecting the user and not harming them. Accordingly, there exists a need for a means by which wheelchairs can be automatically prevented from rolling backwards in an effort to address the above described problems. The development of the anti-roll back mechanism for a wheelchair fulfills this need.

SUMMARY OF THE INVENTION

The principles of the present invention provide for an anti-rollback device installed state on a wheelchair which comprises a mechanical mechanism which prevents unwanted forward movement during usage of the wheelchair by an occupant and a retention bracket which holds a ratchet arm. The ratchet arm is positioned by an armrest of the wheelchair. The ratchet arm has a lower end provided with a ratchet head that connects to a hub of a main side wheel. The anti-rollback device also comprises a three-position ratchet selector switch provided on the ratchet head that is manipulated by the occupant of the wheelchair and a deep wall socket which is attached to a drive square of the ratchet head. The deep wall socket grips a sure grip bushing where it is secured by a setscrew. The anti-rollback device also comprises a bearing which allows rotation between the hub and an axle of the wheelchair to allow the sure grip bushing to be affixed to the hub, an axle bolt head which is positioned at an end of the axle of the wheelchair and a plurality of spikes which are attached to the axle bolt head and are contained within the deep wall socket.

The ratchet arm may be provided on a right side of the wheelchair. The ratchet arm may be provided on a left side of the wheelchair. A plurality of spokes may emanate from the hub to the main side wheel. The three-position ratchet selector may be manipulated by a care provider who is pushing it. The ratchet head may allow motion of the wheelchair along a forward movement in a forward-facing position when the user or the care provider is moving the wheelchair along a forward advancing route. The ratchet head may arrest any rearward movement of the wheelchair to prevent unwanted rearward movement. The ratchet head may allow motion of the wheelchair along the rearward movement in a rearward facing position. The ratchet head may prevent forward movement of the wheelchair should the user or the care provider pull the wheelchair backwards up a ramped surface where forward movement is dangerous.

The ratchet head allows for the forward movement or the backward movement of the wheelchair in a middle position. The middle position may be useful when the wheelchair is unoccupied and is manipulated for storage or deployment where frequent forward movement and rearward movement in rapid alternating succession is expected. The middle position may be useful to manipulate the three-position ratchet selector switch between the forward-facing position and the rearward facing position becomes burdensome.

The sure grip bushing may be permanently attached to the hub via mechanical means. The hub may be provided with a quick release button which is adjacent to the three-position ratchet selector switch, to allow for removal of the ratchet head and the associated ratchet arm. The bearing may be in contact between the axle and the sure grip bushing to provide reduced friction as the wheelchair is moved.

The spikes may slide counter to the hub. The anti-rollback device may be standard equipment on the wheelchair. The anti-rollback device may be an aftermarket add-on for an existing wheelchair. The anti-rollback device may be utilized with little or no training. The retention bracket may be installed on an upper part of the wheelchair near the armrest. The deep wall socket may be attached to the sure grip bushing of the ratchet head and is secured to the sure grip bushing with the setscrew.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
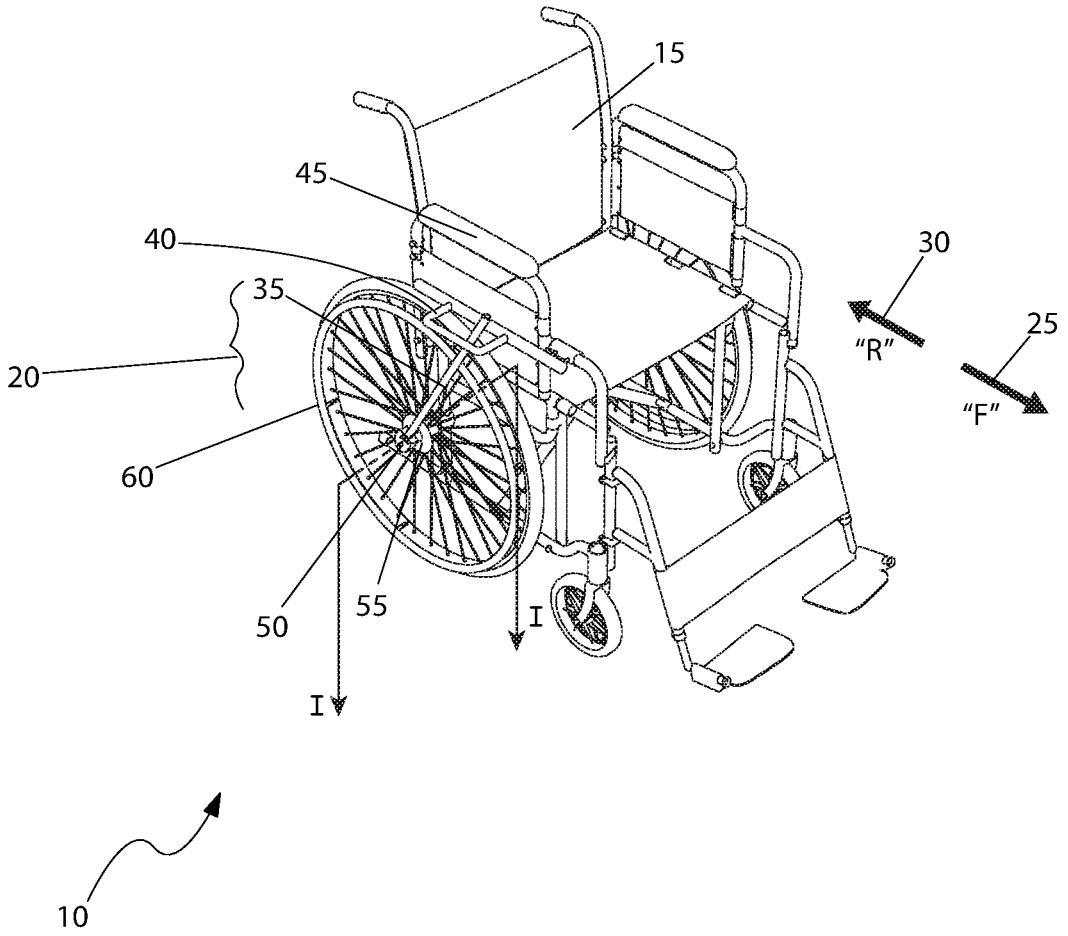
FIG. 1 is a perspective view of the anti-rollback device 10, shown in an installed state on a conventional wheelchair 15, according to the preferred embodiment of the present invention.

10 anti-rollback device
15 conventional wheelchair
20 mechanical mechanism
25 forward movement "F"
30 rearward movement "R"
35 ratchet arm
40 retention bracket
45 armrest
50 ratchet head
55 hub
60 main side wheel
65 three-position ratchet selector switch
70 forward facing position

75 rearward facing position
80 middle position
85 deep wall socket
90 drive square
95 sure grip bushing
100 setscrew
105 bearing
110 axle
115 quick release button
120 axle bolt head
125 spoke
130 spike

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the anti-rollback device 10, shown in an installed state on a conventional wheelchair 15, according to the preferred embodiment of the present invention is disclosed. The anti-rollback device 10 (herein also described as the "device"), includes a mechanical mechanism 20 to prevent unwanted forward movement "F" 25 during usage of the conventional wheelchair 15 by a user. A ratchet arm 35, held semi-captive by a retention bracket 40 is positioned by the armrest 45 of the conventional wheelchair 15. It is noted that the ratchet arm 35 is provided on the right side of the conventional wheelchair 15 (as the user is sitting in the chair). However, the teachings of the device 10 allow for use on the left-hand side of the chair in an equally obvious manner. As such, the use of the device 10 on either the left or right-hand side of the conventional wheelchair 15 is not intended to be a limiting factor of the present invention. The lower end of the ratchet arm 35 is provided with a ratchet head 50 that connects to the hub 55 of the main side wheel 60. Further description of the hub 55 will be provided herein below.

Figure 2:
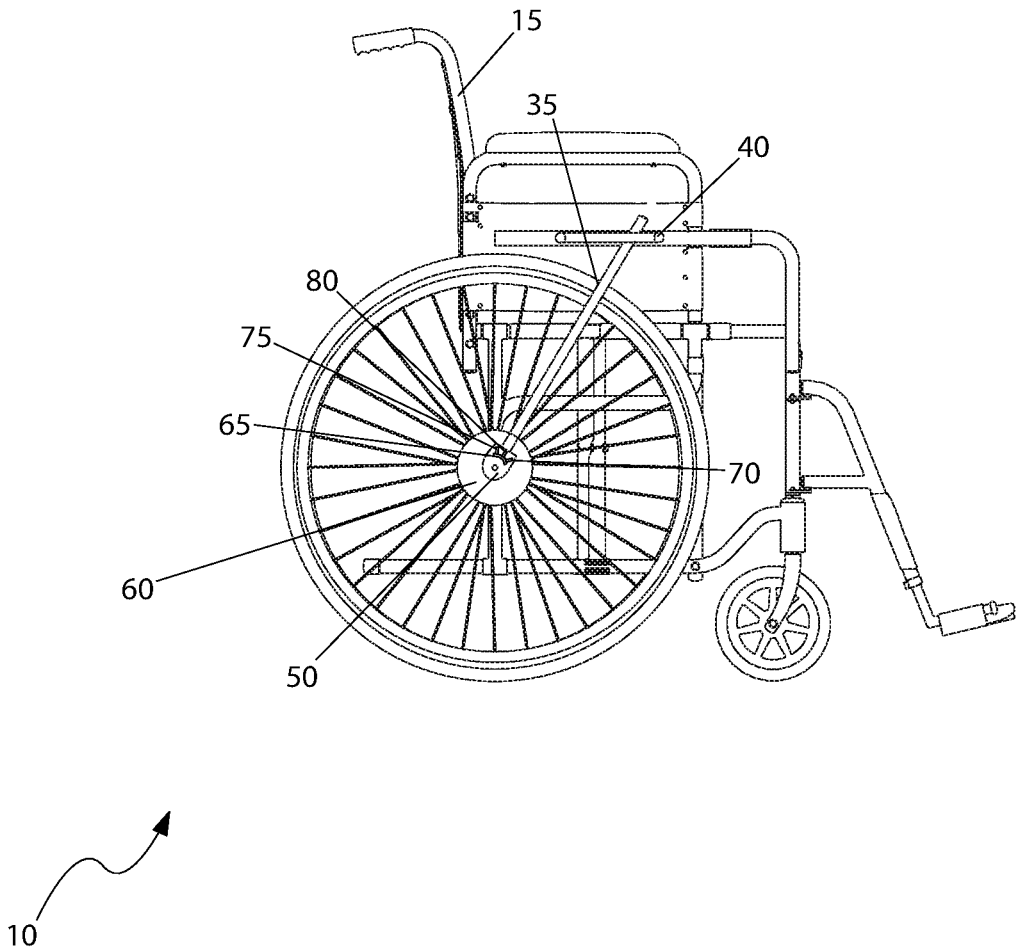
FIG. 2 is a side view of the anti-rollback device 10, shown in an installed state on a wheelchair according to the preferred embodiment of the present invention.

Referring next to FIG. 2, a side view of the device 10, shown in an installed state on a wheelchair according to the preferred embodiment of the present invention is depicted. This view provides further clarification on the physical arrangement between the ratchet arm 35 in the retention bracket 40 and its connection to the ratchet head 50 at the hub 55. A three-position ratchet selector switch 65 is provided on the ratchet head 50 and is capable of being physically manipulated by the occupant of the conventional wheelchair 15 or by a care provider who may be pushing it. In a forward-facing position 70, the ratchet head 50 only allows motion of the conventional wheelchair 15 along the forward movement "F" 25 (as shown in FIG. 1). This motion is envisioned as being typical when the user or care provider is moving the conventional wheelchair 15 along a typical forward advancing route. Any rearward movement "R" 30 (as shown in FIG. 1) is arrested by the ratchet head 50 and prevents movement of the conventional wheelchair 15. This is envisioned as being advantageous should the user be initially sitting the conventional wheelchair 15 where unwanted rearward movement "R" 30 may be expected.

In the rearward facing position 75, the ratchet head 50 only allows motion of the conventional wheelchair 15 along the rearward movement "R" 30 (as shown in FIG. 1). This motion is envisioned as being typical when the user or care provider is moving the conventional wheelchair 15 along a typical rearward advancing route. Any forward movement "F" 25 is arrested by the ratchet head 50 and prevents movement of the conventional wheelchair 15. This is envisioned as being advantageous should the user or care provider may be pulling the conventional wheelchair 15 backwards up a ramped surface where forward movement "F" 25 may be dangerous.

In the middle position 80, the ratchet head 50 allows motion of the conventional wheelchair 15 along either the forward movement "F" 25 or the rearward movement "R" 30 in much the same manner as a conventional wheelchair. This is envisioned to be useful when the conventional wheelchair 15 is unoccupied and it may be being manipulated for the purposes of storage or deployment where frequent forward movement "F" 25 and rearward movement "r" 30 in rapid alternating succession is expected, and the necessity to manipulate the three-position ratchet selector switch 65 between the forward facing position 70 and the rearward facing position 75 becomes burdensome. As the conventional wheelchair 15 is likely unoccupied during this time, any accidental forward movement "F" 25 or rearward movement "r" 30 is not viewed as dangerous.

Figure 3:
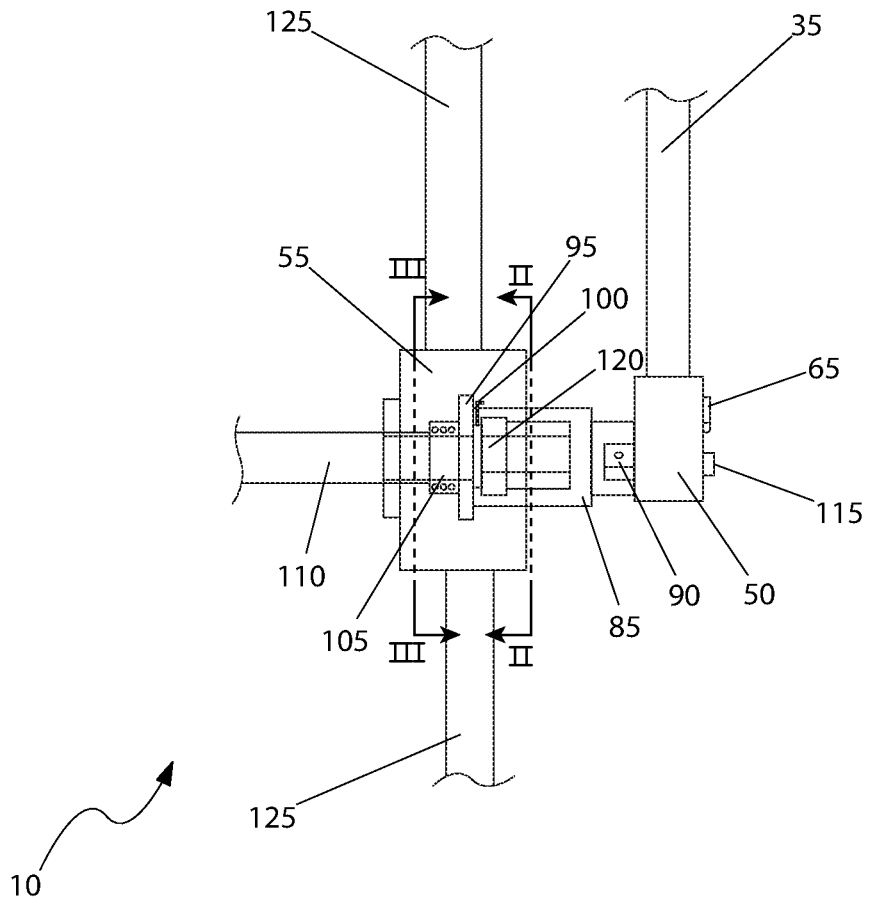
FIG. 3 is a sectional view of the anti-rollback device 10, as seen along a line I-I, as shown in FIG. 1, according to the preferred embodiment of the present invention.

Referring now to FIG. 3, a sectional view of the device 10, as seen along a line I-I, as shown in FIG. 1, according to the preferred embodiment of the present invention is shown. A deep wall socket 85 attaches to the drive square 90 of the ratchet head 50 in a conventional manner. The deep wall socket 85 then grips a sure grip bushing 95 where it is secured by a setscrew 100. The sure grip bushing 95 is permanently attached to the hub 55 via mechanical means. A bearing 105 allows rotation between the hub 55 and the axle 110. This configuration allows the sure grip bushing 95 to be affixed to the hub 55. The hub 55 is provided with a quick release button 115, adjacent to the three-position ratchet selector switch 65, to allow for removal of the ratchet head 50 and the associated ratchet arm 35 for maintenance or other reasons. An axle bolt head 120 is positioned at the end of the axle 110. Multiple spokes 125 are shown emanating from the hub 55 to the main side wheel 60 (as shown in FIG. 1). It is envisioned that the present configuration can be provided as standard or optional equipment on new conventional wheelchair 15 (as shown in FIG. 1) or could be adapted as an aftermarket add-on component for use with existing conventional wheelchair 15.

Figure 4:
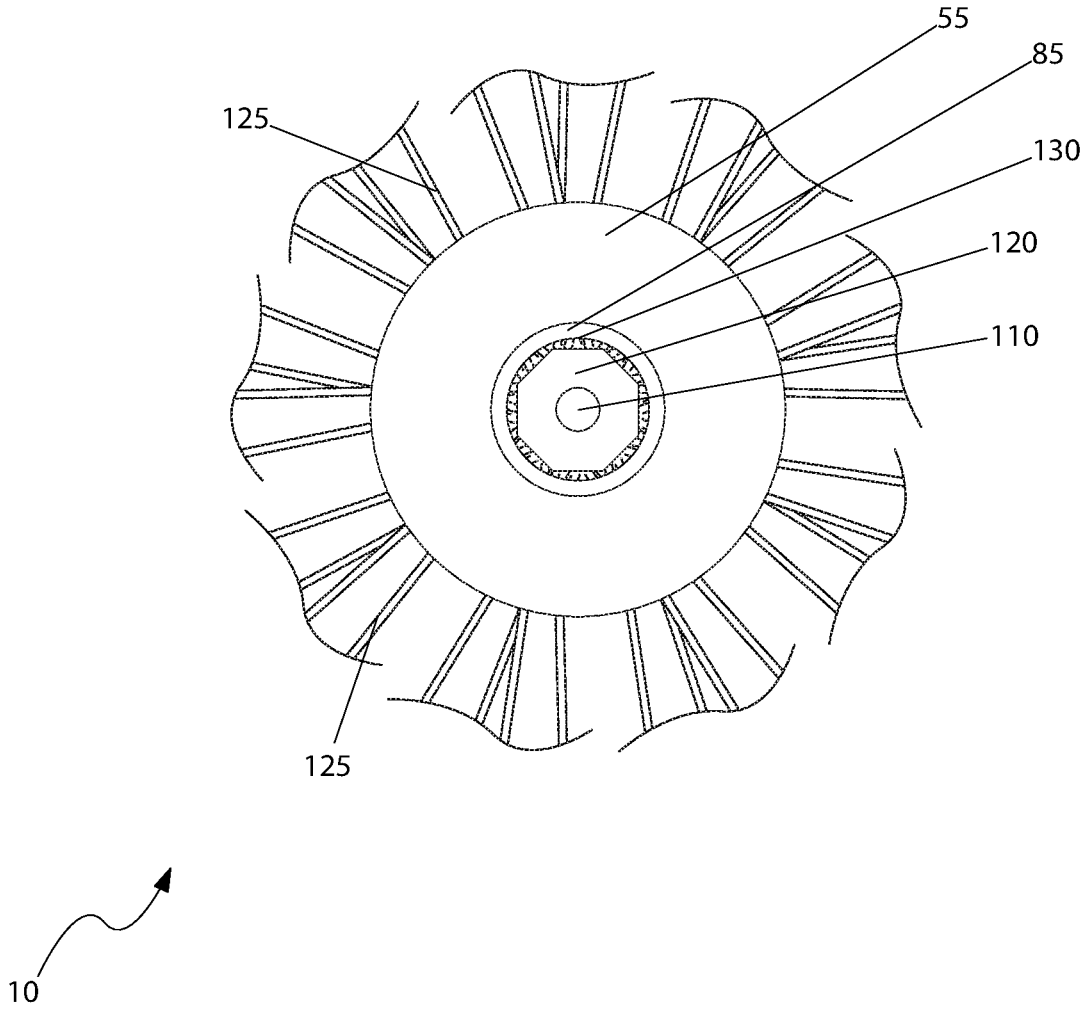
FIG. 4 is a sectional view of the anti-rollback device 10, as seen along a line II-II, as shown in FIG. 3, according to the preferred embodiment of the present invention; and, FIG. 5 is a sectional view of the anti-rollback device 10, as seen along a line III-III, as shown in FIG. 3, according to the preferred embodiment of the present invention.

Referring next to FIG. 4, a sectional view of the device 10, as seen along a line II-II, as shown in FIG. 3, according to the preferred embodiment of the present invention is disclosed. The axle 110 is centrally located and serves as the central axis. The axle bolt head 120 secures the rotating components to the axle 110. A plurality of spikes 130 attach to the axle bolt head 120 and are contained within the deep wall socket 85. It is noted that the spikes 130 slide counter to the direction of the hub 55. The hub 55 with its multiple spokes 125 emanating outward, are located about the perimeter.

Figure 5:
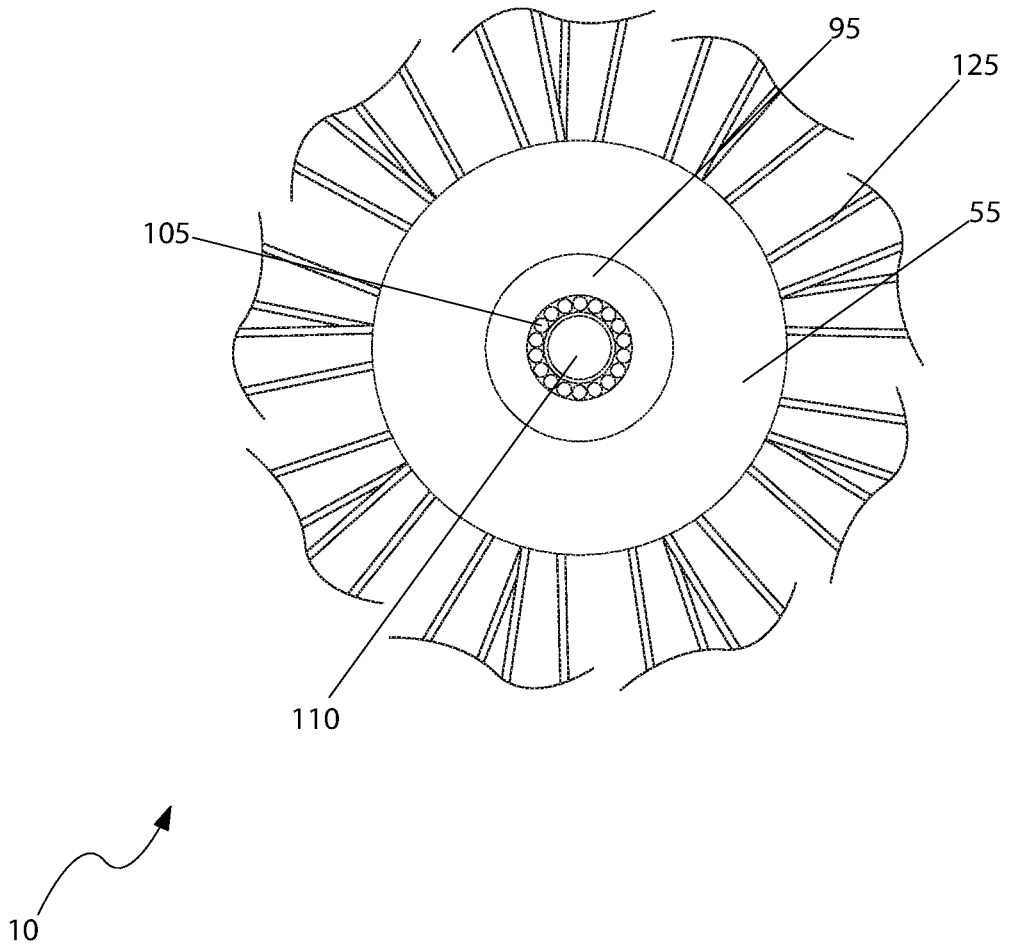

Referring to FIG. 5, a sectional view of the device 10, as seen along a line III-III, as shown in FIG. 3, according to the preferred embodiment of the present invention is depicted. As before the axle 110 is centrally located and serves as the central axis. This direction of view next discloses the bearing 105 in contact between the axle 110 and the sure grip bushing 95 to provide reduced friction as the conventional wheelchair 15 (as shown in FIG. 1) is under movement. The sure grip bushing 95 is in mechanical communication with the hub 55 and the spokes 125.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 from conventional procurement channels such as medical supply warehouses, medical distributors, mail order and internet supply houses and the like. Special attention would be paid to standard or optional equipment on new conventional wheelchair 15 or retrofit operations on existing conventional wheelchair 15.

After procurement and prior to utilization, the device 10 would be prepared in the following manner: the retention bracket 40 would be installed on the upper part of the conventional wheelchair 15 near the armrest 45, the deep wall socket 85 is attached to the sure grip bushing 95 of the ratchet head 50 and secured to the sure grip bushing 95 with the use of the setscrew 100. At this point in time, the device 10 is ready for utilization.

During utilization of the device 10, the following procedure would be initiated: Should forward movement "F" 25 be desired, the three-position ratchet selector switch 65 would be positioned in the forward-facing position 70. As such, the ratchet head 50 only allows motion of the conventional wheelchair 15 along the forward movement "F" 25; said motion is envisioned as being typical when the user or care provider is moving the conventional wheelchair 15 along a typical forward advancing route; any rearward movement "R" 30 is arrested by the ratchet head 50 and prevents movement of the conventional wheelchair 15; this is envisioned as being advantageous should the user be initially sitting the conventional wheelchair 15 where unwanted rearward movement "R" 30 may be expected; should rearward movement "R" 30 be desired, the three-position ratchet selector switch 65 is positioned in the rearward facing position 75; said motion is envisioned as being typical when the user or care provider is moving the conventional wheelchair 15 along a typical rearward advancing route; any forward movement "F" 25 is arrested by the ratchet head 50 and prevents movement of the conventional wheelchair 15; this is envisioned as being advantageous should the user or care provider may be pulling the conventional wheelchair 15 backwards up a ramped surface where forward movement "F" 25 may be dangerous; should free-wheeling motion be desired, the three-position ratchet selector switch 65 is positioned in the middle position 80, said motion of the conventional wheelchair 15 is thus allowed along either the forward movement "F" 25 or the rearward movement "R" 30 in much the same manner as a conventional wheelchair; this is envisioned to be useful when the conventional wheelchair 15 is unoccupied and it may be being manipulated for the purposes of storage or deployment where frequent forward movement "F" 25 and rearward movement "R" 30 in rapid alternating succession is expected, and the necessity to manipulate the three-position ratchet selector switch 65 between the forward facing position 70 and the rearward facing position 75 becomes burdensome.

It is noted that the use of the device 10 provides the following benefits, features, and advantages; easy attached and removed; allows the conventional wheelchair 15 to fold up for travel without removal of invention; slim fit allows the conventional wheelchair 15 to fit through most all doors and tight spaces, allows use of a conventional wheelchair 15 equipped with the device 10 to be utilized as a conventional wheelchair by placement of the three-position ratchet selector switch 65 in the middle position 80; the conventional wheelchair 15 is more stable and is easier to use on ADA ramps; the conventional wheelchair 15 will not roll out of control and is easier to maneuver; the conventional wheelchair 15 will not scoot out from under or away from the user; and the device 10 allows the user to not roll forward out of control when the three-position ratchet selector switch 65 is manipulated from one position to another.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. An anti-rollback device in an installed state on a wheelchair, comprising:

a mechanical mechanism preventing unwanted forward movement during usage of the wheelchair by an occupant;

a retention bracket holding a ratchet arm, the ratchet arm is positioned by an armrest of the wheelchair, the ratchet arm having a lower end provided with a ratchet head that connects to a hub of a main side wheel;

a three-position ratchet selector switch provided on the ratchet head that is manipulated by the occupant of the wheelchair;

a deep wall socket attached to a drive square of the ratchet head, the deep wall socket grips a sure grip bushing where it is secured by a setscrew;

a bearing allowing rotation between the hub and an axle of the wheelchair to allow the sure grip bushing to be affixed to the hub;

an axle bolt head positioned at an end of the axle of the wheelchair; and a plurality of spikes attached to the axle bolt head that are contained within the deep wall socket.

2. The anti-rollback device according to claim 1, wherein the ratchet arm is provided on a right side of the wheelchair.

3. The anti-rollback device according to claim 1, wherein the ratchet arm is provided on a left side of the wheelchair.

4. The anti-rollback device according to claim 1, wherein a plurality of spokes are emanating from the hub to the main side wheel.

5. The anti-rollback device according to claim 1, wherein the three-position ratchet selector is manipulated by a care provider who is pushing the wheelchair.

6. The anti-rollback device according to claim 5, wherein the ratchet head allows motion of the wheelchair along a forward movement in a forward-facing position when a user or the care provider is moving the wheelchair along a forward advancing route.

7. The anti-rollback device according to claim 6, wherein the ratchet head arrests any rearward movement of the wheelchair to prevent unwanted rearward movement.

8. The anti-rollback device according to claim 1, wherein the ratchet head allows motion of the wheelchair along the rearward movement in a rearward facing position.

9. The anti-rollback device according to claim 8, wherein the ratchet head prevents forward movement of the wheelchair should a user or a care provider pull the wheelchair backwards up a ramped surface where forward movement is dangerous.

10. The anti-rollback device according to claim 1, wherein the ratchet head allows for the forward movement or the backward movement of the wheelchair in a middle position.

11. The anti-rollback device according to claim 10, wherein the middle position is useful when the wheelchair is unoccupied and is manipulated for storage or deployment where frequent forward movement and rearward movement in rapid alternating succession is expected.

12. The anti-rollback device according to claim 11, wherein the middle position is useful to manipulate the three-position ratchet selector switch between the forward-facing position and the rearward facing position.

13. The anti-rollback device according to claim 11, wherein the sure grip bushing is permanently attached to the hub via mechanical means.

14. The anti-rollback device according to claim 11, wherein the hub is provided with a quick release button, adjacent to the three-position ratchet selector switch, to allow for removal of the ratchet head and the associated ratchet arm.

15. The anti-rollback device according to claim 1, wherein the bearing is in contact between the axle and the sure grip bushing to provide reduced friction as the wheelchair is moved.

16. The anti-rollback device according to claim 1, wherein the spikes slide counter to the hub.

17. The anti-rollback device according to claim 1, wherein the anti-rollback device is standard equipment on the wheelchair.

18. The anti-rollback device according to claim 1, wherein the anti-rollback device is an aftermarket add-on for an existing wheelchair.

19. The anti-rollback device according to claim 1, wherein the anti-rollback device is utilized with little or no training.

20. The anti-rollback device according to claim 1, wherein the retention bracket is installed on an upper part of the wheelchair near the armrest, the deep wall socket is attached to the sure grip bushing of the ratchet head and is secured to the sure grip bushing with the setscrew.

* * * * *